United States Patent [19]

Kataoka

[11] Patent Number: 4,619,235

[45] Date of Patent: Oct. 28, 1986

[54] AIR-FUEL RATIO CONTROL SYSTEM

[75] Inventor: Ryuji Kataoka, Mitaka, Japan

[73] Assignee: Fuji Jukogyo Kabushiki Kaisha, Tokyo, Japan

[21] Appl. No.: 710,183

[22] Filed: Mar. 11, 1985

[30] Foreign Application Priority Data

Mar. 14, 1984 [JP] Japan ..... 59-49581

[51] Int. Cl.[4] ..... F02D 41/14

[52] U.S. Cl. ..... 123/440; 123/489

[58] Field of Search ..... 123/440, 489, 589

[56] References Cited

U.S. PATENT DOCUMENTS 4,241,710 12/1980 Peterson, Jr. et al. ..... 123/440

4,425,895 1/1984 Yoshida et al. ..... 123/440

4,502,443 3/1985 Hasegawa et al. ..... 123/440

*Primary Examiner*—Andrew M. Dolinar

*Attorney, Agent, or Firm*—Martin A. Farber

[57] ABSTRACT

An air-fuel control system for an automotive engine which keeps the engine idling speed at a predetermined value. In the system, engine idling state is determined by signals from an idle-switch, and a neutral switch provided in a transmission. When the number of peaks of the fluctuating feedback signal of a feedback control circuit exceeds a predetermined value, the feedback signal is fixed to a predetermined value, so that air-fuel ratio is fixed to a value, thereby keeping the idling speed to a constant value.

2 Claims, 5 Drawing Figures

AIR-FUEL RATIO CONTROL SYSTEM

BACKGROUND OF THE INVENTION

The present invention relates to a system for controlling air-fuel ratio for an automotive engine mounted on a motor vehicle so as to prevent fluctuation in engine speed while the engine is idling.

Many air-fuel ratio control systems with a three-way catalytic converter have been proposed for cleaning exhaust gases. The control system is provided with an $O_2$-sensor and a feedback control system which performs a feedback operation using an output signal of the $O_2$-sensor to control the air-fuel ratio to the stoichiometric air-fuel ratio which is most effective for the three-way catalytic converter for purifying the exhaust gases. In such a system, the air-fuel ratio cannot be fixed to a constant value, but varies in the vicinity of the stoichiometric air-fuel ratio. Therefore, under the idling condition of the engine, the engine speed fluctuates as the air-fuel ratio varies, causing problems such as unstable fuel combustion.

FIG. 1 shows a PI signal from a proportion and integration (PI) circuit in the feedback control system, the air-fuel ratio, and the engine speed which varies in accordance with the variation of the air-fuel ratio.

SUMMARY OF THE INVENTION

Therefore, the object of the present invention is to solve such problems occurring in the conventional system, and to provide and air-fuel control system capable of keeping the engine idling speed at a predetermined value.

In the system of the present invention, the engine idling state is determined by signals from a coolant sensor, an idle-switch, and a neutral switch provided in a transmission. When the number of peaks of the fluctuating feedback signal exceeds a predetermined value, the feedback signal is fixed to a predetermined value, so that the variation of the air-fuel ratio stops, thereby keeping the idling speed at a constant value.

According to the present invention, there is provided and air-fuel ratio control system for an automotive engine mounted on a vehicle, having a transmission, a fuel control device and a cooperating feedback control system responsive to the output of an $O_2$-sensor. The system comprises first means for detecting the idling condition of the engine and for producing a first signal, second means responsive to the first signal for starting counting of the number of peaks in the feedback signal of the feedback control system and for producing a second signal when the count exceeds a predetermined value, and third means responsive to the second signal for producing an output to fix the feedback signal to a predetermined value.

In an aspect of the present invention, the first means comprises an idle switch for detecting the position of a throttle valve of the engine and for producing a signal when it is at the closed position, and a neutral switch for detecting the position of a shift lever of the transmission and for producing a signal when the shift lever is at a neutral position.

Other objects and features of this invention will be apparently understood from the following description with reference to the accompanying drawings.

DETAILED EXPLANATION OF THE PREFERRED EMBODIMENT

The present invention will be hereinafter explained with reference to FIGS. 2–5.

Figure 3:
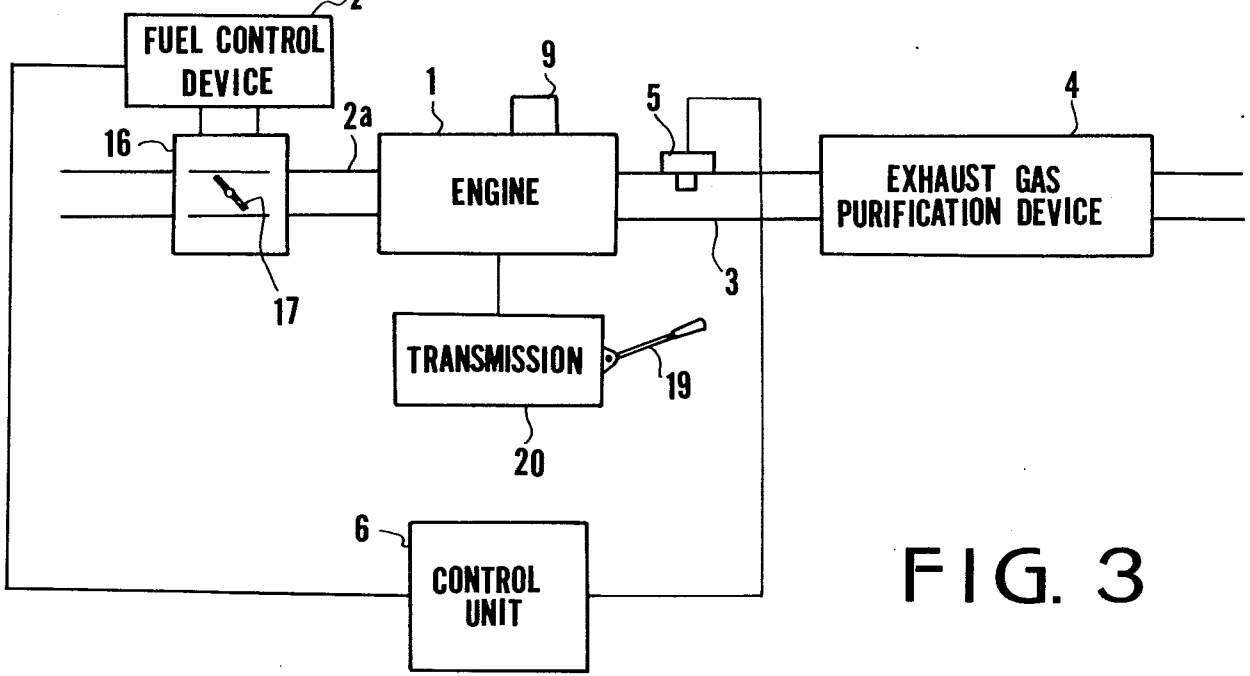
FIG. 3 is a block diagram showing an embodiment of the present invention.

As shown in FIG. 3, an automotive engine 1 is provided with an intake passage *2a*, and a fuel control device 2 such as an on-off type electromagnetic valve provided in a carburetor 16 having a throttle valve 17. An exhaust gas purification device 4 such as a three-way catalytic converter is provided in an exhaust pipe 3 from the engine. Disposed on the exhaust pipe 3 is an $O_2$-sensor 5 which applies its output signal to a control unit 6, which, in turn, applies a feedback signal to the fuel control device 2, so that the air-fuel ratio may be controlled to the stoichiometric air-fuel ratio.

Figure 5:
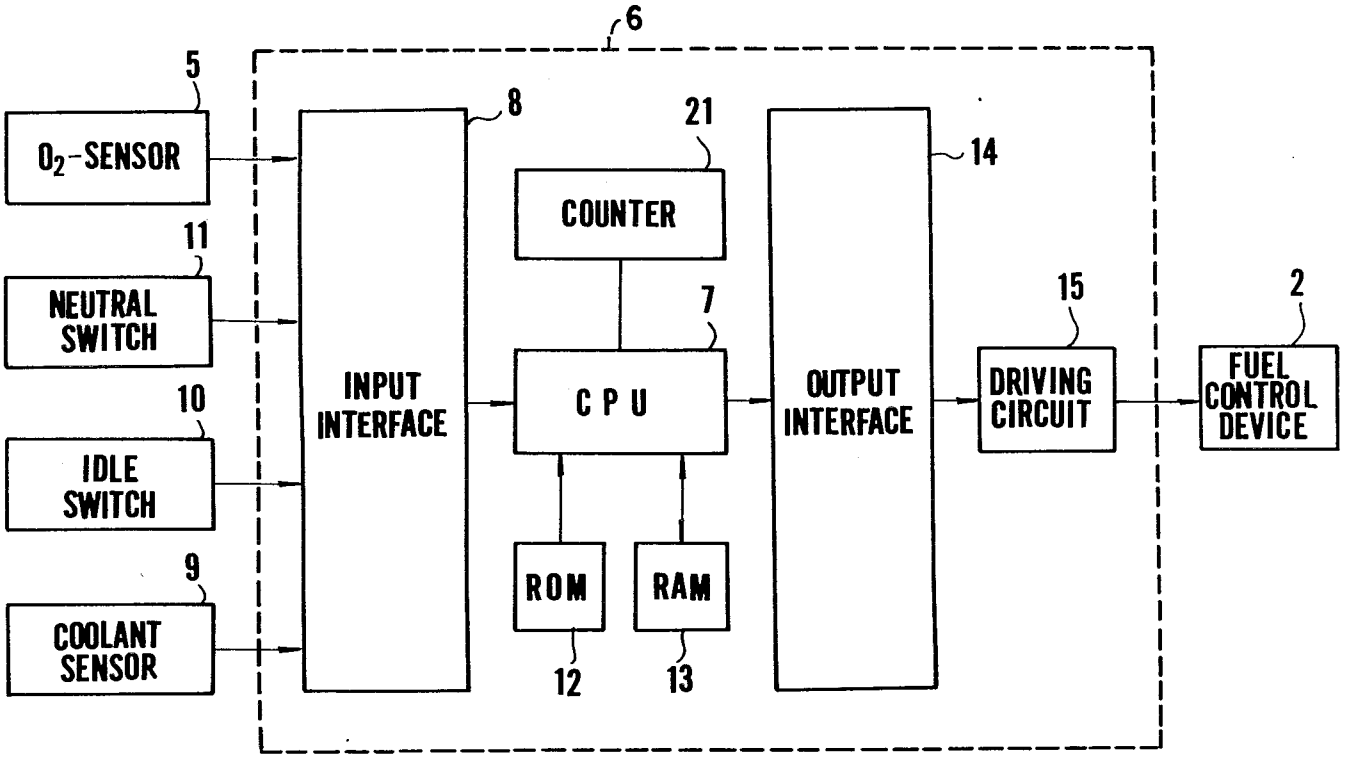
FIG. 5 shows details of a control unit in the system of the present invention.

As shown in further detail in FIG. 5, the control unit 6 comprises a microcomputer. The control unit 6 is provided with a central processing unit (CPU) 7 applied with an output signal from an input interface 8 which is applied with the output of the $O_2$-sensor 5, and with outputs of a coolant sensor 9, an idle switch 10, and a neutral switch 11. The coolant sensor detects coolant temperature and produces the an output when the engine is warmed up. The idle switch 10 detects the idling condition of the engine by detecting the throttle valve position in the closed state. The neutral switch 11 produces an output when a gear shift lever 19 of a transmission 20 is at the neutral position. The CPU 7 processes these signals according to programs stored in a ROM 12 and a RAM 13 and drives a driving circuit 15 through an output interface 14, to control the fuel control device 2. The CPU 7 includes a PI circuit responsive to the output of the $O_2$-sensor 5 to produce a PI signal as a feedback signal as shown in FIG. 2.

Figure 4:
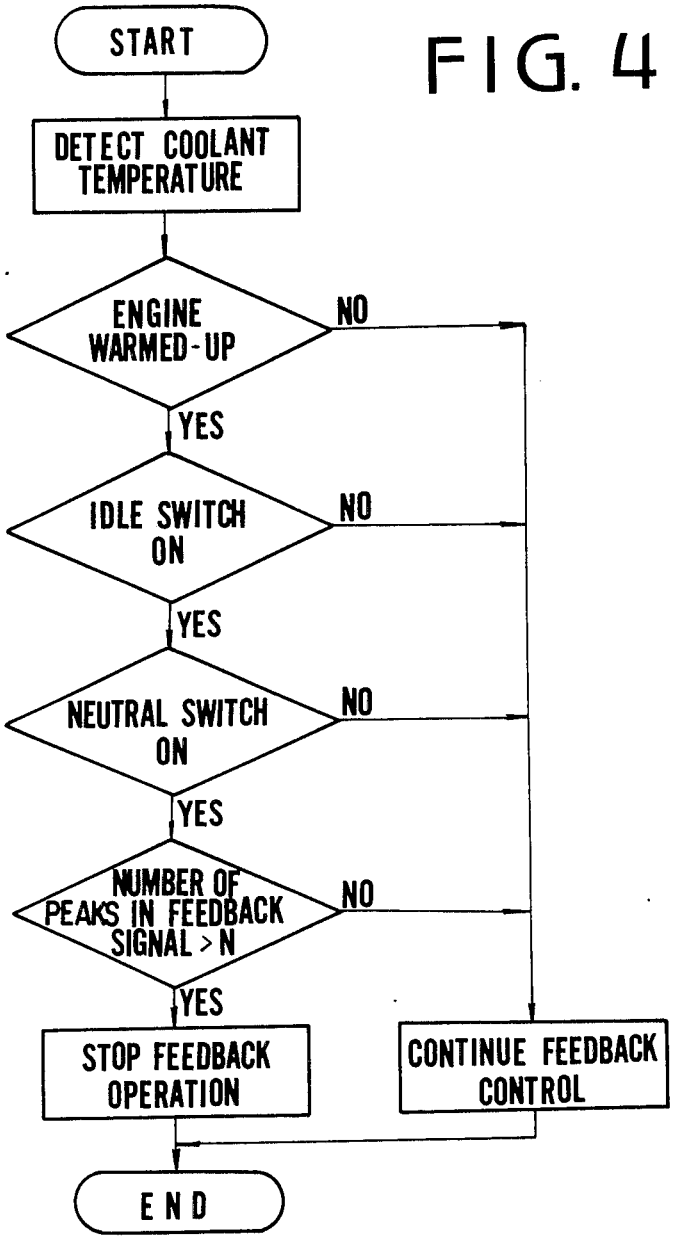
FIG. 4 is a flow chart showing the operation of the system.

The operation of the system is explained hereinafter, according to the flow chart of FIG. 4. If the coolant sensor 4 produces an output during warming up of the engine 1, the air-fuel ratio is controlled to stoichiometry by the feedback signal dependent on the output of the $O_2$-sensor 5. After the engine is warmed-up, the system determines whether the engine is at idling or not. First, the output of the idle switch 10 is judged. When the switch is ON, the operation proceeds to the next stage; if OFF, the system keeps on carrying out its ordinary control operation. In the next stage, the state of the neutral switch 11 is detected. It is is ON, operation progresses to the next stage; and if OFF, the system continues carrying out ordinary feedback control. The idling condition of the engine is determined by the ON signal of the neutral switch 11. In the idling condition, the number of the peaks in the feedback signal (PI signal) is counted by a counter 21. When the number does not exceed a predetermined value N, the system operates to carry out its ordinary feedback control. When the number exceeds the value N, feedback control by the feedback signal is stopped and a signal having a predetermined feedback value is applied to the fuel control device 2. Accordingly, the air-fuel ratio is fixed to a predetermined value, causing the engine speed to be constant.

Figure 1:
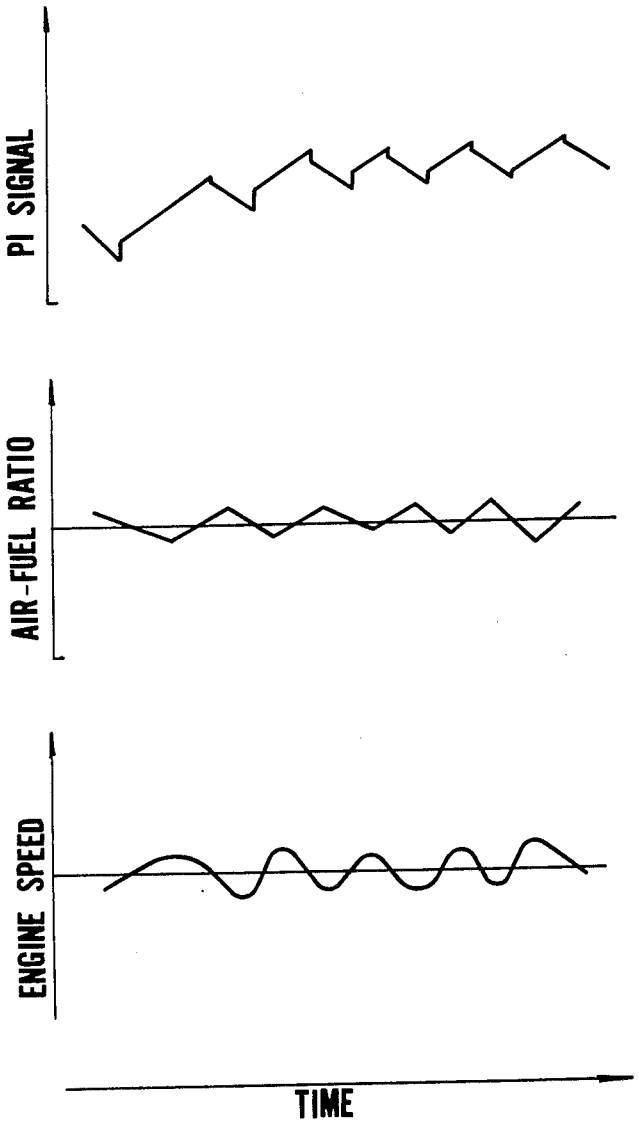
FIG. 1 PRIOR ART
FIG. 1 shows a PI signal and the relationship between the air-fuel ratio and engine speed while the engine is idling, in a conventional system.
Figure 2:
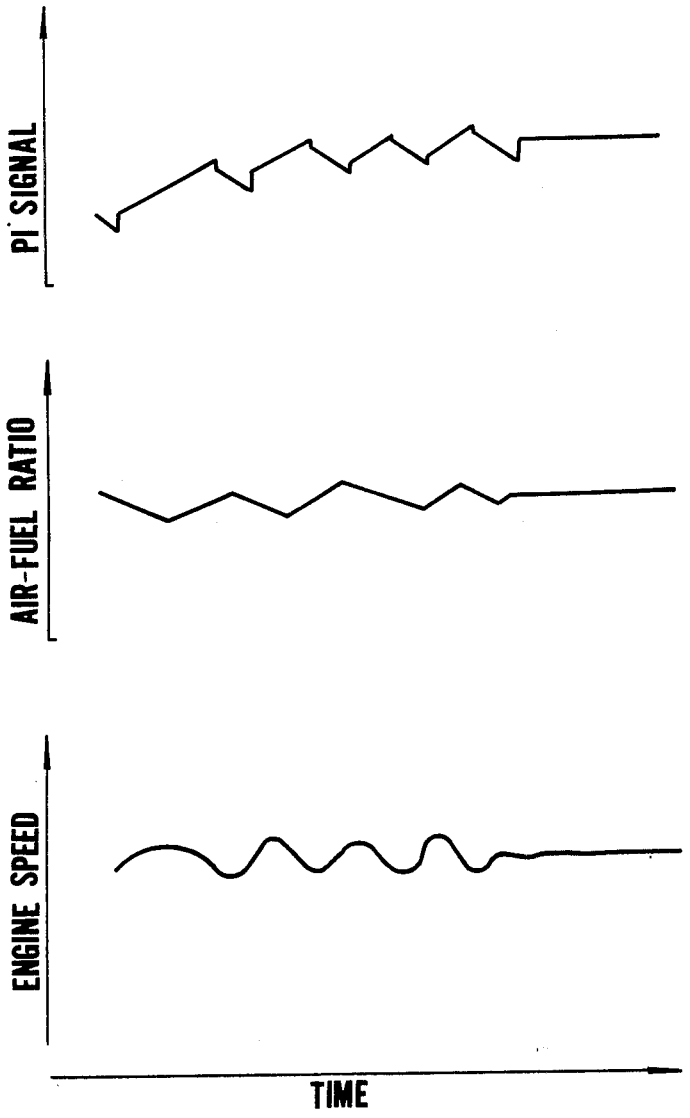
FIG. 2 shows fluctuations in air-fuel ratio and the engine speed while the engine is idling and the PI signal, in a system according to the present invention.

Thus, as shown in FIG. 2, if the idling condition lasts longer than a predetermined period, the air-fuel ratio may be fixed, so that fluctuation of engine speed is prevented and the fuel combustion efficiency is improved.

From the foregoing, it is now clear that the present invention provides an air-fuel ratio control system in which the fluctuation of engine speed is prevented by controlling the air-fuel ratio, so that fuel combustion efficiency improves. Herein the term peaks refers to upwardly or downwardly directed peaks.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. In an air-fuel ratio control system for an automotive engine mounted on a vehicle, having a transmission, a fuel control device, a feedback control system responsive to the output of an $O_2$-sensor for producing a feedback signal having a plurality of voltage peaks for operating the fuel control device, the improvement comprising:

first means for detecting the idling condition of the engine and for producing a first signal;

second means responsive to the first signal for starting counting the number of the peaks in the feedback signal of the feedback control system and for producing a second signal when the count exceeds a predetermined value;

third means responsive to the second signal for producing an output to fix the feedback control system to a predetermined value.

2. The air-fuel ratio control system according to claim 1, wherein the first means comprises an idle switch for detecting the position of a throttle valve of the engine and for producing a signal when the throttle valve is in closed position, and a neutral switch for detecting the position of a shift lever of the transmission and for producing a signal when the shift lever is at a neutral position.

* * * * *